US005282643A

United States Patent [19]

Jungkind

[11] Patent Number: 5,282,643

[45] Date of Patent: Feb. 1, 1994

[54] HEEL HOLDER ARRANGEMENT OF A SAFETY SKI BINDING

[76] Inventor: Roland Jungkind, Bärenalplstr. 3, D-8100 Garmisch-Partenkirchen, Fed. Rep. of Germany

[21] Appl. No.: 863,803

[22] Filed: Apr. 6, 1992

[51] Int. Cl.[5] ..... A63C 9/084

[52] U.S. Cl. ..... 280/626; 280/634

[58] Field of Search ..... 280/623, 626, 631, 632, 280/634, 633

[56] References Cited

U.S. PATENT DOCUMENTS

| | | | |
|---|---|---|---|
| 4,629,209 | 12/1986 | Lorenz et al. | 280/626 |
| 4,758,017 | 7/1988 | Stritzl et al. | 280/626 |
| 4,915,407 | 4/1990 | Brischoux | 280/626 |

*Primary Examiner*—Richard M. Camby
*Attorney, Agent, or Firm*—Hoffmann & Baron

[57] ABSTRACT

A heel holder arrangement of a safety ski binding has a sole holder which is pivotable about a first axis parallel to the surface of the ski between a position of locking the heel of a ski boot and a release position. Arranged behind the sole holder and pivotable about a second parallel axis is a retaining lever which at its upward end carries at least one retaining roller. The retaining roller co-operates both with a cam surface on the sole holder and also with a cam surface on a pivotable opening lever which is loaded by a compression spring. The cam surface on the sole holder includes a retaining recess in which the retaining roller is engaged when the sole holder is in the locking position. The spring is pivotable with the opening lever. The cam surfaces jointly determine the force-travel characteristic of the sole holder both in the event of safety release of the arrangement and also upon voluntary opening by actuation of the opening lever. A brace member is pivoted at a first end on the first axis and has its second end engaging the rear of the sole holder. At its first end the brace member also has a contact surface which can be engaged by the end of the compression spring as it is pivoted upon pivotal actuation of the opening lever. The brace member being pivoted about the first axis under the spring loading, it causes the sole holder to be pivoted into its release position after the movement of the opening lever allows the retaining roller to come out of the retaining recess of the cam surface of the sole holder.

26 Claims, 4 Drawing Sheets

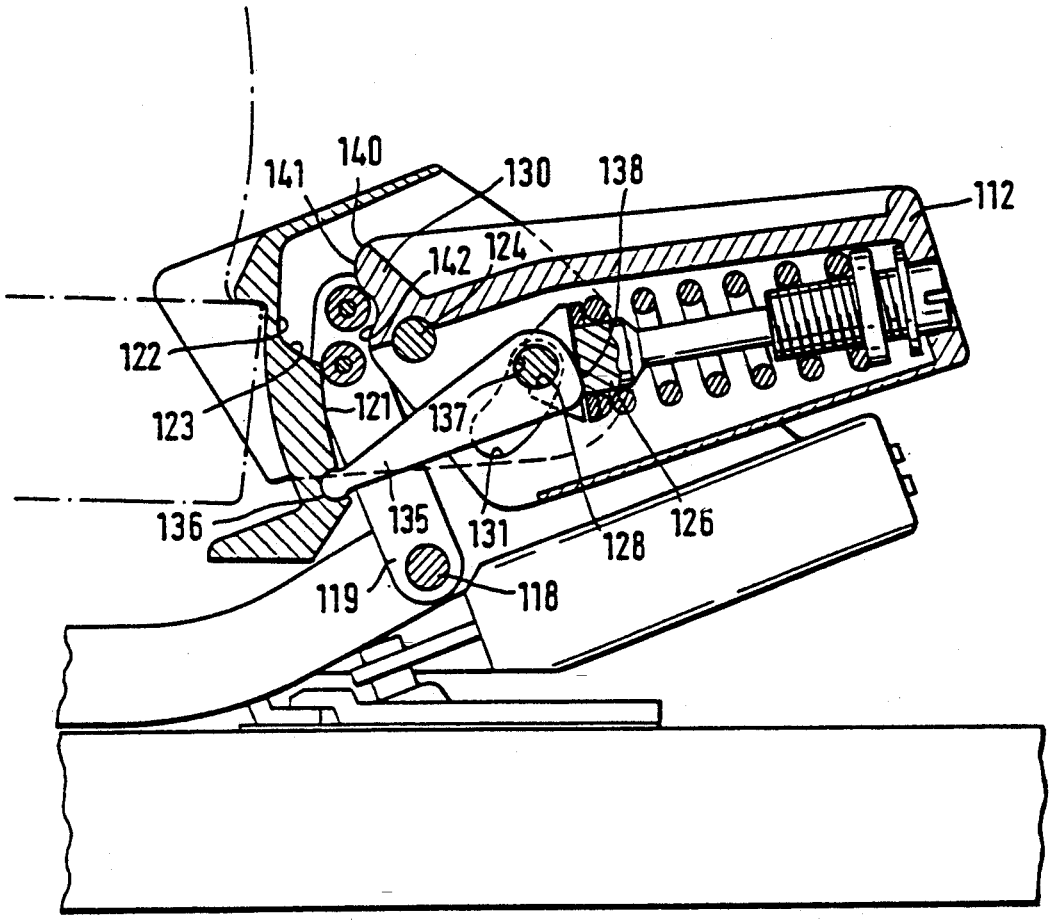
Fig. 5
Fig. 6
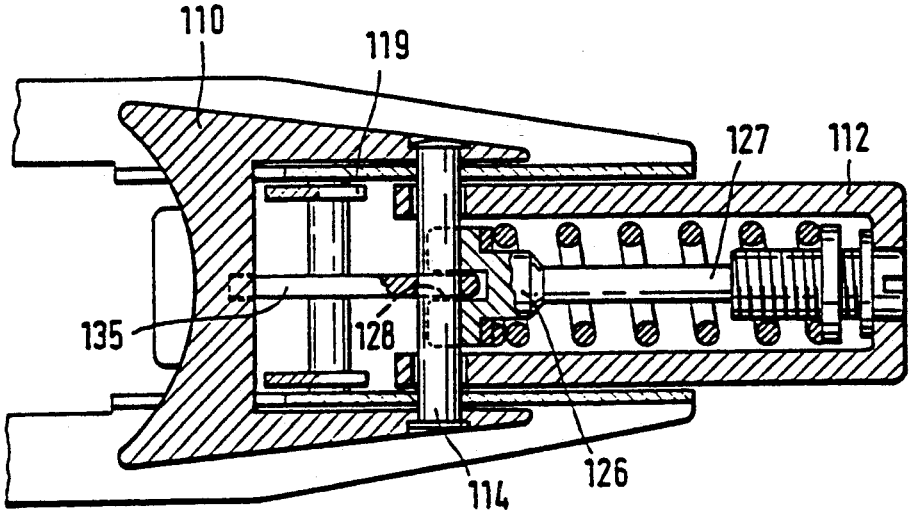

HEEL HOLDER ARRANGEMENT OF A SAFETY SKI BINDING

BACKGROUND OF THE INVENTION

This invention is generally concerned with a heel holder arrangement of a safety ski binding.

A safety ski binding typically comprises a front sole holding arrangement which is operable to hold the front edge of the sole of a ski boot in position, and a heel holding arrangement which similarly locates the heel of the ski boot on the ski. In a heel holding arrangement as disclosed in German laid-open application (DE-OS) No 33 22 634, a sole holder which, when in the locking position, engages over the upper edge of the sole at the heel end of the boot thereby to fix the boot on the ski, carries at its lower end a kicker or spur portion on which the skier presses with the heel of his boot in order to fit the boot into the safety ski binding, by consequentially moving the sole holder into the locking position. So that the sole holder is always held in the condition of being ready for insertion of a boot, and also for assembly reasons, it is desirable for the movement of the sole holder out of the locking position into the release position to occur substantially automatically under the effect of the force of a spring, when an opening lever for releasing the sole holder is actuated. For that purpose, the opening lever of the above-indicated known arrangement is mounted pivotably on the sole holder, with the mounting axis for the opening lever being arranged behind and below the mounting axis for the sole holder. Therefore, when the opening lever is pressed down, the sole holder is already loaded in the direction of opening of the holder arrangement, in the first phase of the movement involved. In addition, that heel holder arrangement has a retaining lever to hold the sole holder in its locking position, and the retaining lever and the opening lever are connected by a coupling member which forms a spring plate for the compression spring which urges the sole holder from the locking position towards the release position. The sole holder further comprises a cam configuration which in turn also provides a cam detent portion or notch arranged to receive a roller carried on the retaining lever to hold the sole holder in the locking position. The cam configuration is such that the sole holder can pivot into its release position under the influence of the compression spring, by way of the retaining roller, as soon as the retaining roller has moved out of the above-mentioned cam notch. The retaining lever is mounted behind the sole holder, pivotably about an axis which is parallel to the pivot axis of the sole holder, with the retaining roller being carried on the retaining lever at its upper end. The opening lever is mounted pivotably about a third axis which extends parallel to the surface of the ski on which the ski binding is used. The compression spring of the heel holder arrangement bears against the coupling member so that the retaining lever is spring-loaded thereby and the retaining roller is thus urged against the cam configuration, thereby to define the force/travel characteristic involved in the opening movement of the sole holder. As noted above, the retaining roller can engage into a notch in order for the ski boot to be held under a spring force on the ski, while the cam configuration in the region of that notch, in conjunction with the lever arm of the retaining roller and the lever arm in respect of engagement of the spring against the retaining lever define the release time in respect of safety release of the heel holder arrangement. The cam configuration outside the notch thereof determines the force required for insertion of a ski boot into the holder, being the force which the skier must overcome by standing on the above-mentioned spur portion of the sole holder in order thereby to pivot the sole holder from its release position into its locking position. When the opening lever is actuated by the skier, to release the holder arrangement, the retaining roller is lifted out of the notch in the cam configuration so that the sole holder can pivot upwardly in an unloaded condition.

The fact that the compression spring bears against the coupling member which connects the retaining lever and the opening lever, the way in which the coupling member is disposed in the assembly, and the arrangement of the compression spring in the housing beneath the opening lever, means that the arrangement requires a relatively large amount of space while in addition the structural size thereof is increased as a result.

SUMMARY OF THE INVENTION

An object of the present invention is that of providing a heel holder arrangement for a safety ski binding, which permits the sole holder to open automatically upon actuation of an opening lever of the arrangement while however being of a compact construction so that it can be used in particular in conjunction with a plate-type ski binding.

A further object of the present invention is to provide a heel holder arrangement of a safety ski binding, which is of a compact construction without the desired force/-travel characteristic of the sole holder being adversely affected.

Still another object of the present invention is to provide a heel holder arrangement of a compact structure and a simple design configuration, which is reliable in operation in the sense of firmly holding a ski boot in position while ensuring adequate safety release.

In accordance with the principles of the present invention, the foregoing and other objects are attained by a heel holder arrangement as set forth herein.

In accordance with a preferred feature of the invention, the first axis about which the sole holder is pivotable also forms the compression spring support means which is fixed with respect to the housing, and in accordance with a further preferred feature, that same axis also serves for pivotally mounting the brace member for urging the sole holder towards its release position.

As the brace member only has to transmit to the sole holder the compression force required for pivoting the sole holder upwardly, but otherwise performs no function outside of the operation of voluntarily and deliberately opening the heel holder arrangement, the brace member can be of a very small and light construction. The contact surface which is provided thereon and on to which the pressing portion of the compression spring passes in the pivotal movement of the opening lever for opening the heel holder arrangement is disposed eccentrically relative to the pivot axis of the brace member, whereby in the opening movement, due to the prestressing effect which occurs in respect of the compression spring, a compression or thrust force is applied to the sole holder in the direction of opening thereof. In that situation, the brace member can be constantly in contact with the sole holder at the rear thereof, but it is also possible for the brace member to be so short that it only comes into contact with the sole holder from the rear thereof, in the course of actuation of the brace member by the compression spring.

In order to ensure that the compression spring is pivotable together with the opening lever, in a preferred feature of the invention the compression spring includes a guide shank which at its one end carries the pressing portion co-operating with the brace member. The pressing portion is mounted pivotably on a support means which is fixed with respect to the housing, in the above-discussed preferred construction on the pivot axis of the sole holder, while however also being displaceable in the axial direction of the spring or its guide shank. That arrangement on the one hand provides for satisfactory pivotal movement of the spring in conjunction with the opening lever upon actuation of the latter, while on the other hand also permitting the compression spring to be prestressed in the necessary manner for moving the sole holder into the release position thereof, when the pressing portion moves on to the contact surface of the brace member.

Furthermore, as will be seen in greater detail hereinafter, the heel holder arrangement according to the invention provides that the spring force for loading the retaining member is transmitted by way of a contact surface of the opening lever, which bears directly against the retaining member. In a release procedure, by virtue of the pivotal movement of the sole holder and the opening lever which inevitably occurs in that situation, the contact surface changes in its relative position with respect to the retaining member. The result of this is that the contact surface forms a further cam configuration which, together with the cam configuration of the sole holder, determines the force/travel characteristic of the sole holder. That consideration applies both in regard to safety release in which the sole holder pivots upwardly against the spring force after the predetermined opening force is exceeded, and also upon voluntary or deliberate opening of the holder arrangement by actuation of the opening lever. In the latter case, the contact surface is moved relative to the retaining member by virtue of actuation of the opening lever so that the path of movement of the retaining member and thus the pivotal movement of the retaining lever are determined by the configuration of the contact surface on the opening lever.

As a result of that additionally available further cam configuration in the form of the contact surface on the opening lever, which in conjunction with the cam configuration of the sole holder establishes the force/travel characteristic, the arrangement enjoys a greater degree of freedom in regard to the design of the cam configuration. For, the situation is now that the shape of the cam configuration on the sole holder and in particular the local angle of the cam detent or notch as far as the release edge, that is to say, to the point of transition to the part of the cam configuration which is outside the cam detent or notch, does not on its own determine the pivotal movement of the retaining lever and therewith the prestressing effect in respect of the spring. On the contrary, when the retaining member moves relative to the force-transmitting contact surface on the opening lever, there is also a variation in the lever arm of the force which is operative as between the contact surface on the opening lever and the retaining member, with respect to the pivot axis of the opening lever, and thus the moment which determines the spring prestressing. Accordingly, on the one hand the force to be applied to the above-mentioned kicker or spur member by the skier when fitting the heel of the ski boot into the heel holder arrangement and on the other hand the opening force required for automatically upwardly pivoting the sole holder when the heel holder arrangement is to be voluntarily or deliberately opened, both those forces being established by the configuration outside the cam detent or notch, can be kept low at the desired level.

The precise cam configuration both at the cam on the cam holder and also at the contact surface on the opening lever is determined in consideration of the respective design of the sole holder, compression spring and opening lever. Irrespective thereof however it is generally found to be advantageous for the contact surface on the opening lever to be in the form of a cam with a concavely inwardly extending cam portion into which the retaining member can pass upon pivotal movement of the sole holder into the release position thereof. The inwardly extending cam portion adjoins that cam portion of the contact surface on the opening lever, which is in contact with the retaining member when the sole holder is in the locking position.

The contact surface on the opening lever is advantageously formed by a nose-shaped projection thereon.

In accordance with still another preferred feature of the invention, the retaining member may be formed by first and second retaining rollers which are disposed on the retaining lever and which are arranged parallel or coaxial with respect to each other, one thereof co-operating with the cam configuration on the sole holder and the other with the contact surface on the opening lever. The retaining rollers which are each in contact separately from each other with the cam configuration of the sole holder and the contact surface on the opening lever eliminate an undesirable frictional effect which would otherwise take place in the event of a single roller rolling simultaneously against both cam configurations.

Further objects, features and advantages of the present invention will be apparent from the following description of preferred embodiments of the invention.

BRIEF DESCRIPTION OF THE DRAWINGS

FIG. 5 is a view similar to that shown in FIG. 4 and illustrating part thereof, but on a larger scale, showing the heel holder arrangement in its release position, and FIG. 6 is a view in section taken along line VI—VI in FIG. 4 through the heel holder arrangement, with parts being omitted for the sake of enhanced clarity of the drawing.

DESCRIPTION OF PREFERRED EMBODIMENTS

Figure 1:
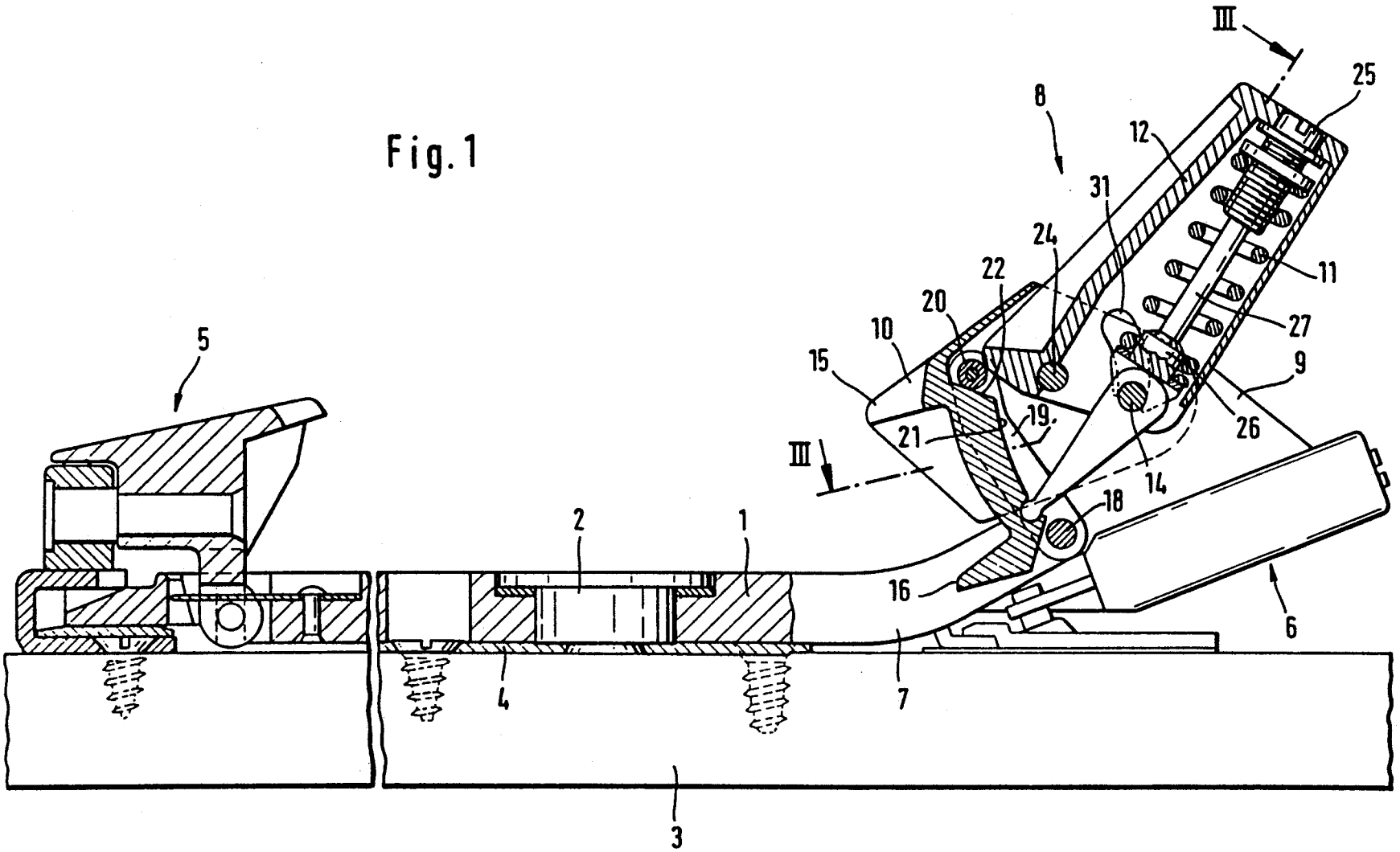
FIG. 1 is a side view in partial section of a plate-type safety ski binding with a heel holder arrangement according to the invention in the locking position, the view being shortened in the longitudinal direction of the ski.

Referring firstly to FIG. 1, shown therein is a safety ski binding in the form of a plate-type ski binding having a sole plate 1 which is pivotable about a pivot mounting 2 in parallel relationship to the surface of a ski which is only diagrammatically indicated at 3. The pivot mounting 2 is screwed fast to the ski 3 by means of a base plate 4.

Arranged at the front end of the sole plate 1, which is thus towards the left in FIG. 1, is a front sole holder arrangement 5 which can embrace the front edge of the sole of a ski boot (not shown) from above and from the side. A side holder arrangement which is generally identified by reference numeral 6 is provided to give support, which is resilient towards the side, for the rearward end of the sole plate 1. The front sole holder arrangement 5 and the side holder arrangement 6 which is towards the heel end of the ski binding are not part of the present invention and will therefore not be described in greater detail at this point. They may be of any suitable nature and configuration, and reference may be directed in that respect to PCT application No WO 82/02495.

Arranged at the rearwardly and upwardly angled end portion 7 of the sole plate 1, which is towards the right in FIG. 1, is a heel holder arrangement which is generally identified by reference numeral 8 and which essentially comprises a housing 9, a sole holder 10, a compression spring 11 which loads the sole holder 10, and an opening lever 12. In the illustrated embodiment in FIG. 1, the housing 9 is formed integrally with the rear end portion 7 of the sole plate and for that purpose essentially comprises two vertically disposed walls (not referenced). The sole holder 10 is mounted pivotably about an axis 14 formed by for example a pin or spindle which is fixedly disposed in the housing 9 and which extends at least substantially parallel to the surface of the ski 3. At its upper edge, the sole holder 10 has a projection 15 with which it engages over the upper edge of the sole at the heel end of a ski boot (not shown), in the locking position of the heel holder arrangement as shown in FIG. 1. At its lower edge the sole holder 10 has a kicker spur portion 16 on which the skier presses with the ski boot heel to move the sole holder into the locking position shown in FIG. 1, in a manner that will become apparent hereinafter.

A retaining lever 19 is mounted pivotably behind the sole holder 10 on an axis 18 which is fixed with respect to the housing 9. At its upper free end the retaining lever 19 carries a retaining roller 20. The retaining lever 19 is essentially in the form of an upwardly open U-shape, the web portion of which is disposed at the axis 18 while the two limb portions thereof are connected together by the shaft or spindle which carries the retaining roller 20.

The retaining roller 20 co-operates with a cam 21 which is provided at the rear side (towards the right in FIG. 1) of the sole holder 10 and which at its upper end in FIG. 1 has a retaining notch or recess 22. In the locking position shown in FIG. 1, the retaining lever 19 occupies a pivotal position in which the retaining roller 20 is disposed in the retaining notch or recess 22 so that as a result the sole holder 10 is prevented from pivoting upwardly about its pivot mounting at 14.

Figure 3:
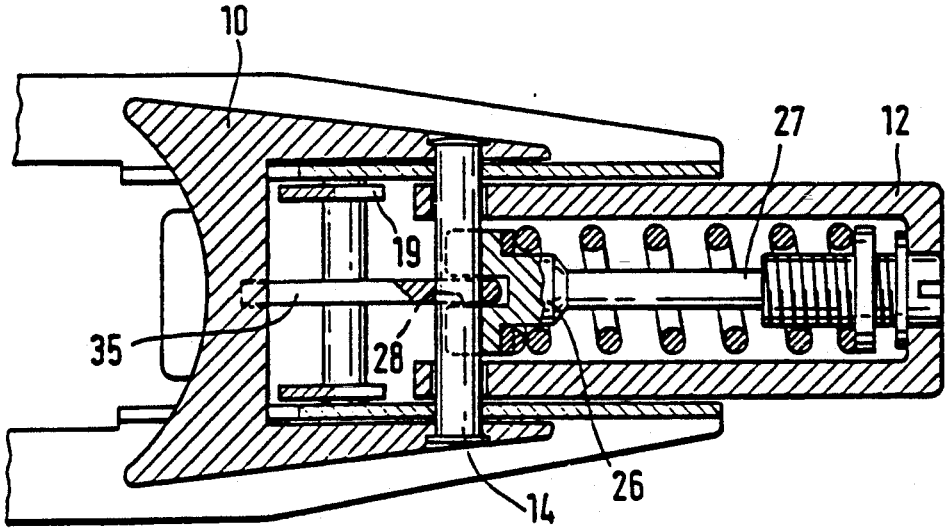
FIG. 3 is a view in section taken along line III—III in FIG. 1 through the heel holder arrangement, with members having been omitted for the sake of enhanced clarity of the drawing.

The opening lever 12 is mounted pivotably on a third pivot axis 24 which is fixed with respect to the housing 9 and which is at least substantially parallel to the surface of the ski 3. The opening lever 12 forms a housing for the compression spring 11 which is accommodated therein and which bears with its rearward upper end against the opening lever 12 by way of an adjusting screw 25 and with its lower end against the pivot axis member 14 of the sole holder 10, by way of a pressing portion 26. The pressing portion 26 is provided integrally at the lower end of a guide shank 27 for the compression spring 11 and has a forked mounting opening which can be clearly seen at 28 in FIG. 3 and with which it embraces the axis member 14 from above and is pivotally mounted thereon. The flanks of the mounting opening 28 embrace the pivot axis 14 in such a way that the pressing portion 26 and therewith the guide shank 27 are displaceable transversely to the pivot axis 14. In that movement, the upper end portion of the guide shank 27 slides in a bore (not shown) in the adjusting screw 25.

Figure 2:
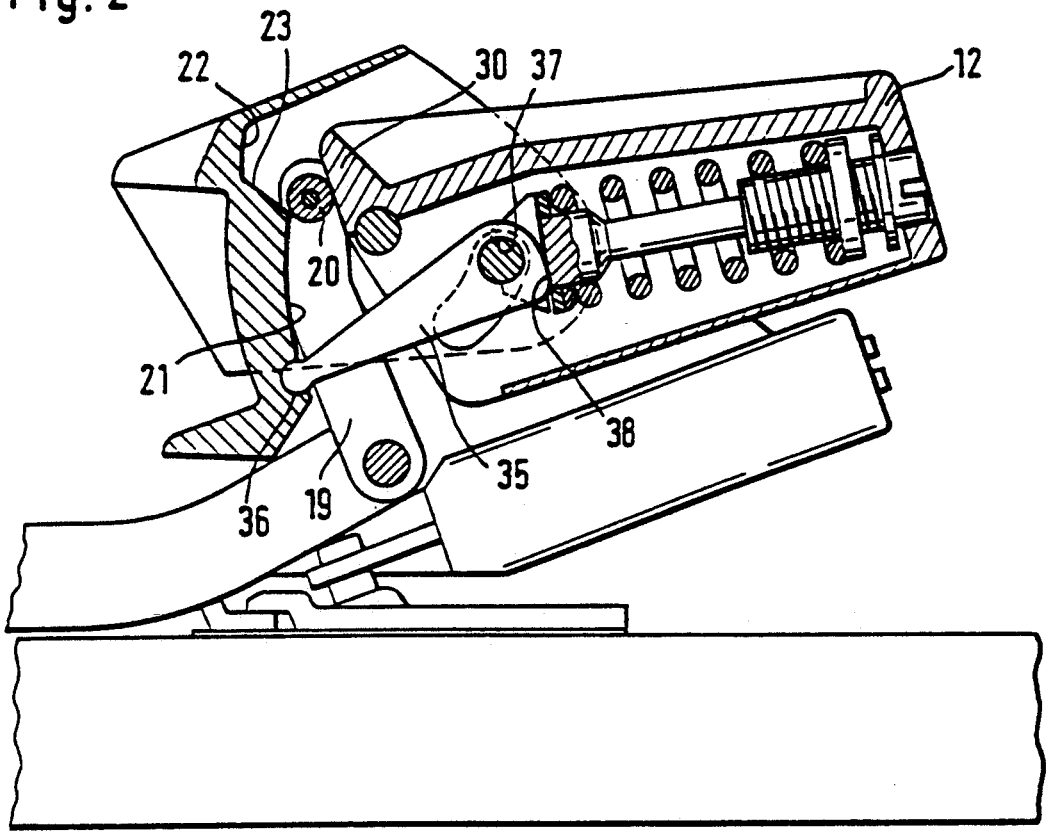
FIG. 2 is a sectional view similar to that shown in and illustrating part of FIG. 1, showing the heel holder arrangement in the release position thereof.

Looking now additionally at FIG. 2, reference numeral 30 therein identifies a nose-like projection at the upper front edge of the opening lever 12. The projection 30 is urged by the force of the compression spring 11 into constant contact with the central portion of the retaining roller 20, between the two limb portions of the U-shaped retaining lever 19. In that way the retaining roller 20 is in turn urged against the cam 21 on the sole holder 10, with corresponding pivotal movement of the retaining lever 19. When the sole holder 10 is in the locking position shown in FIG. 1, the retaining roller 20 is disposed in the retaining notch or recess 22 and is held therein by the force of the compression spring 11. The compression spring 11 thus determines the safety release action of the heel holder arrangement 8 as it is only at a force which is determined by the prestressing of the compression spring 11, that the retaining roller 20 can be lifted out of the retaining notch or recess 22, with a simultaneous increase in the degree of prestressing of the compression spring 11. The force acting on the retaining roller 20 is produced by the flank indicated at 23 in FIG. 2 of the retaining notch or recess 22, due to an action corresponding to the effect of an inclined plane. When the arrangement is in the position shown in FIG. 2, the retaining roller 20 is just at the transition from the flank 23 to the downwardly extending leg portion of the cam 21 and can pass through the intermediate space between the projection 30 and the cam 21. Accordingly, by virtue of the upwardly directed force applied to the sole holder 10 by the ski boot, the sole holder 10 can pivot upwardly about its axis 14 into the release position shown in FIG. 2. In order to permit the opening lever 12 to perform the pivotal movement which takes place in that situation, the opening lever 12, in each of its side walls, has a respective arcuate slot 31 through which the pivot axis 14 passes.

A brace or strut member 35 in the form of a flat stamped member is also pivotally mounted on the pivot axis member 14. The brace member 35 bears with its front end which is of a rounded configuration in a recess which is indicated at 36 in FIG. 2 at the rear of the sole holder 10, while at its rear end portion the brace member 35 has a mounting bore indicated at 37 in FIG. 2, through which passes the pivot axis 14. The rear end face of the brace member 35, in its part which in FIG. 1 is to the left of the center line of the guide shank 27, is of a contour in the form of a circular arc, the center of curvature of which lies at the middle of the pivot axis 14. To the right of the center line of the guide shank 27, the rear end face of the brace member 35 goes into a run-on or contact surface which is indicated at 38 in FIG. 2 and which projects in a cam-like configuration, the spacing thereof from the center of the pivot axis 14 increasing in a clockwise direction from a position corresponding to the center line of the guide shank 27, as can be clearly seen from FIG. 2. The dimensions of the brace member 35 and in particular the rear end face thereof, and the pressing portion 26, in particular the mounting opening thereof, are so matched to each other that, when the components are in the relative position shown in FIG. 1, the compression spring 11 bears fully against the pivot axis 14 and the rear end face of the brace member 35 bears substantially without any force against the pressing portion 26, at most, with its arcuate contour.

Having described the structure of the heel holder arrangement 8 according to the invention, the mode of operation thereof will now be set forth as follows:

When the sole holder 10 is in the locking position shown in FIG. 1, the retaining roller 20 is disposed in the retaining notch or recess 22 and is held therein by the projection 30 on the opening lever 12, under the force of the compression spring 11. The sole holder 10 can therefore urge the retaining roller 20 and therewith the projection 30 towards the right in FIG. 1, only by overcoming the prestressing force of the compression spring 11. That situation arises in the event of safety release of the heel holder arrangement.

The sole holder 10 can be voluntarily moved from the locking position shown in FIG. 1 into the release position shown in FIG. 2 by means of actuation of the opening lever 12. For that purpose the opening lever 12 is pivoted in the clockwise direction in FIGS. 1 and 2 about its pivot axis 24 by hand or by means of a ski pole, in which case the compression spring 11 is also pivoted with the opening lever 12 by virtue of being disposed therein. As the pivot axis 14 against which the compression spring 11 bears is disposed in the vicinity of the pivot axis 24 on which the opening lever 12 is pivotally mounted, but is at a small spacing therefrom and behind same, the result of the pivotal movement of the compression spring 11 is prestressing of the compression spring, which increases with an increasing angle of pivotal movement. In addition, in that situation, the pressing portion 26 performs a part-circular movement about the pivot axis 14, in the course thereof moving on to the run-on or contact surface 38 at the end of the brace member 35. As a result, the pressing portion 26 is lifted out of contact with the pivot axis 14, with the compression spring 11 being further stressed at the same time. On the other hand, with increasing pivotal movement of the opening lever 12 and with the pressing portion 26, as a result, moving on to the contact surface 38 of the brace member 35, the compression spring 11 applies an increasing force to the brace member 35, which tends to pivot the brace member 35 about the pivot axis 14 in the clockwise direction. As the brace member 35 bears against the sole holder 10, a corresponding torque is applied to the sole holder 10, tending to urge it in a direction towards its release position.

Since, as a result of the pivotal movement of the opening lever 12, the projection 30 thereof moves away from the retaining notch or recess 22, the retaining roller 20 is urged out of the retaining notch or recess 22 under the effect of the rearwardly directed force applied to the roller 22 by the flank 23 of the retaining notch or recess 22, until the retaining roller 20 moves into the position shown in FIG. 2. In that position, the retaining roller has practically completely left the retaining notch or recess 22 so that the sole holder 10 is now no longer blocked and is abruptly pivoted upwardly into its release position by virtue of the force applied by the compression spring 11 by way of the brace member 35.

When the opening lever 12 is released again, the compression spring 11 pivots it back into its starting position again. As however the sole holder 10 now occupies its release position, the retaining roller 20 is pressed by the projection 30 against the portion of the cam 21 which is disposed beneath the retaining notch or projection 22.

When the sole holder 10 is subjected to a downward loading, for example by the skier standing with the heel of his boot on the kicker spur portion 16 of the sole holder 10, the retaining roller 20 moves upwardly again on the cam 21 until it again passes into the retaining notch or projection 22 and as a result the sole holder 10 again occupies its locking position.

It should be noted at this point that various modifications may be made in the structure described above with reference to FIGS. 1 through 3, for example the axis 18 may coincide with the axis 24, so that the retaining lever 19 is mounted coaxially with the opening lever 12. The pressing portion 26 also does not necessarily have to be disposed at the end of the compression spring 11 as illustrated, but may also be connected to the windings of the compression spring 11 at a spacing from the end thereof.

Figure 4:
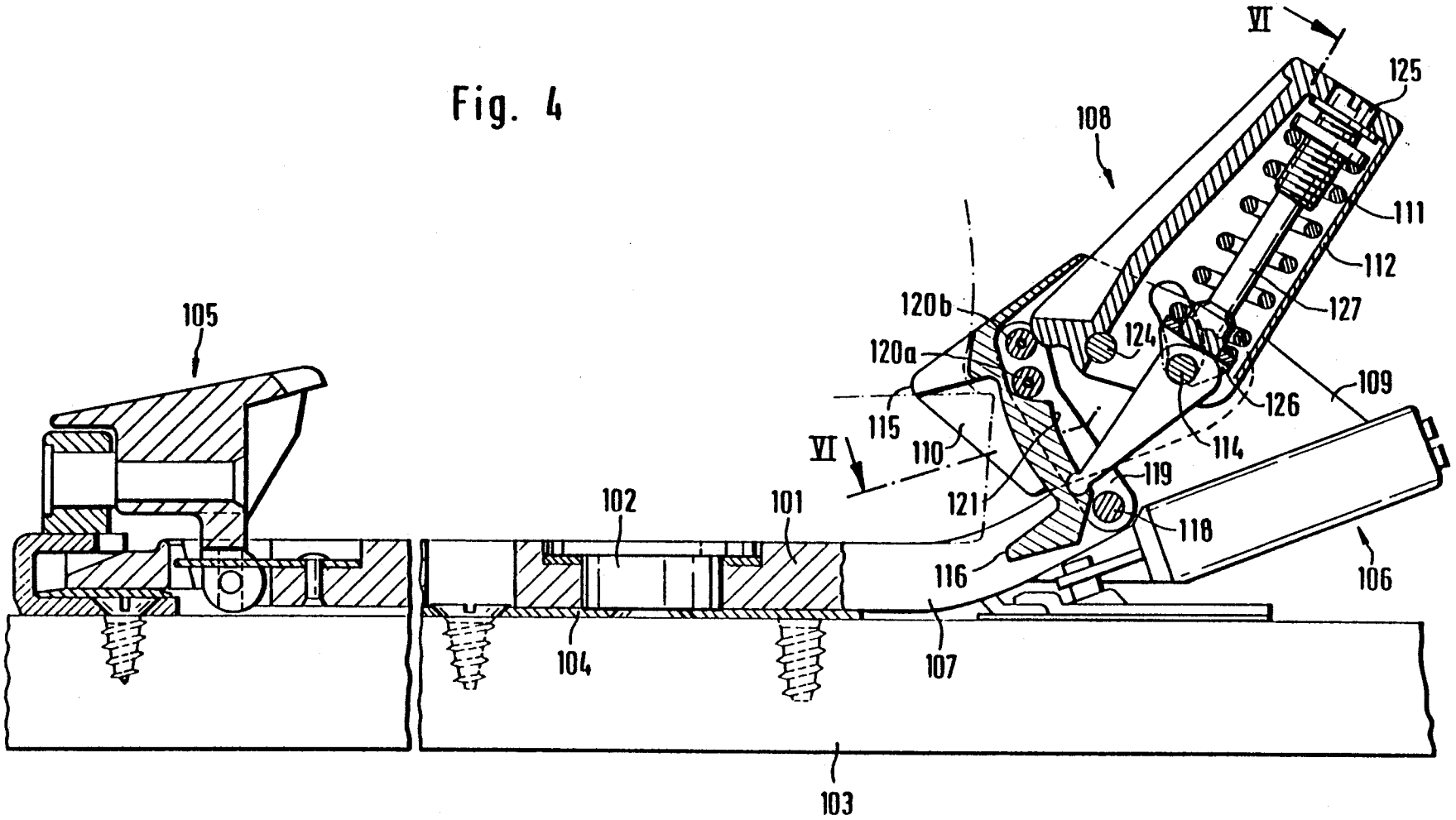
FIG. 4 is a view corresponding to that shown in FIG. 1 of a plate-type ski binding with a second embodiment of the heel holder arrangement according to the invention in the locking position.

Reference will now be made to FIGS. 4 through 6 showing a plate-type safety ski binding with a different embodiment of a heel holder arrangement according to the invention.

Thus, looking firstly at FIG. 4, the safety ski binding illustrated therein comprises a sole plate 101 which is pivotable about a pivot mounting 102 in parallel relationship to the surface of a ski which is only diagrammatically indicated at 103. The pivot mounting 102 is screwed fast to the ski 103 by means of a base plate 104.

Arranged at the front end of the sole plate 101, which is towards the left in FIG. 4, is a front sole holder arrangement 105 which can embrace the front edge of the sole of a ski boot (not shown) from above and from the side. A side holder arrangement which is generally identified by reference numeral 106 is provided for support, which is resilient towards the side, for the rearward end of the sole plate 101, towards the right in FIG. 4. The front sole holder arrangement 105 and the side holder arrangement 106 are not part of the present invention and will therefore once again not be described in detail at this point. Once again they may be of any suitable kind in the same fashion as described with reference to FIGS. 1 through 3.

A heel holder arrangement according to the invention which is generally identified by reference numeral 108 is arranged at the rearwardly and upwardly angled end portion 107 of the sole plate 101. The heel holder arrangement 108 essentially comprises a housing 109, a sole holder 110, a compression spring 111 for loading the sole holder 110, and an opening lever 112. The housing 109 in the illustrated embodiment in FIGS. 4 through 6 is formed integrally with the rearward end portion 107 of the sole plate 101 and for that purpose essentially comprises two substantially vertically disposed walls. The sole holder 110 is mounted pivotably about an axis 114 which is arranged fixedly in the housing 109 and which extends at least substantially parallel to the surface of the ski 103. At its upper edge in FIG. 4 the sole holder 110 has a projection 115 with which, in the locking position shown in FIG. 4, it engages over the upper edge of the sole at the heel end of a ski boot, as indicated by the broken line in FIGS. 4 and 5, while at its lower edge the sole holder 110 has a kicker spur portion 116 on which the skier stands when fitting his boot into the heel holder arrangement 108.

Mounted pivotably behind the sole holder 110 on an axis 118 which is fixed with respect to the housing 109 and which extends parallel to the axis 114 is a retaining lever 119 which carries first and second retaining rollers 120*a* and 120*b* at its free upper end portion. It will be seen that the retaining roller 120*b* is above the retaining roller 120*a* in the position of the retaining lever 119 shown in FIG. 4. The retaining lever 119 is essentially in the form of an upwardly open U-shape, the web portion of which is disposed at the axis 118 while its two limb portions are connected together by the axis or spindle members which carry the respective retaining rollers 120*a* and 120*b* and which extend parallel to each other.

The lower retaining roller 120*a* co-operates with a cam 121 which is provided at the rear side of the sole holder 110 and which at its upper end in FIG. 4 has a retaining notch or recess which is shown in both FIGS. 4 and 5 and which is referenced at 122 in FIG. 5. In the locking position of the heel holder arrangement as shown in FIG. 4, the retaining lever 119 occupies a pivotal position in which the lower retaining roller 120*a* is disposed in the retaining notch or or recess 122 so that the sole holder 110 is prevented from pivoting upwardly by the flank indicated at 123 in FIG. 5 of the retaining notch or recess 122.

The opening level 112 is mounted pivotably on a pivot axis 124 which is fixed with respect to the housing 109 and which is parallel to the axes 114 and 118. The opening lever 112 forms a housing for the compression spring 111 which is accommodated therein and which bears with its rear upper end against the opening lever 112 by way of a non-rotatable nut of an adjusting screw 125 while the front lower end of the compression spring 111 bears by way of a pressing portion 126 against the pivot axis 114 of the sole holder 110. The pressing portion 127 is provided integrally at the lower end of a guide shank 127 for the compression spring 111 and has a forked mounting opening 128 with which it embraces the axis 114 from the rear and from above and is mounted pivotably thereon. The flanks of the mounting opening 128 embrace the pivot axis 114 in such a way that the pressing portion 126 and therewith the guide shank 127 are displaceable transversely relative to the pivot axis 114, that is to say, can be lifted somewhat away therefrom. In that situation the upper end portion of the guide shank 127 slides in a bore (not shown) in the adjusting screw 125.

Provided at the front upper edge of the opening lever 112 is a nose-like projection which is indicated at 130 in FIG. 5 and which is urged by the force of the compression spring 111 into constant contact with the central portion of the upper retaining roller 120*b*, namely, between the two limb portions of the U-shaped retaining lever 119. As a result, the retaining lever 119 is urged in the counter-clockwise direction about its axis 118 and accordingly the lower retaining roller 120*a* is pressed against the cam 121 or into the retaining notch or recess 122 thereof. Therefore, when the sole holder 110 is in the locking position shown in FIG. 4, the lower retaining roller 120*a* lies in the retaining notch or recess 122 and is held therein by the force of the compression spring 111.

The contact surface with which the projection 130 bears under the force of the compression spring 111 against the upper retaining roller 120*b* is shaped as a curve portion or cam 140 against which the upper retaining roller 120*b* runs upon pivotal movement of the opening lever 112. The cam 140 has an upper convex cam portion 141 and a concave cam portion 142 which adjoins the cam portion 141 below same. When the sole holder 110 is in the locking position shown in FIG. 4, the contact surface or cam 140 bears with its convex cam portion 141 against the upper retaining roller 120*b*. In that position therefore the compression spring 111 determines the safety release action of the heel holder arrangement 108 as it is only at a force which is determined by the prestressing of the compression spring 111, that the lower retaining roller 120*a* can be lifted out of the retaining notch or recess 122 of the cam 121 on the sole holder 110. The force which acts on the lower retaining roller 120*a* in that situation and which seeks to pivot the retaining lever 119 in the clockwise direction is produced by the flank 123 of the retaining notch or recess 122, by an action corresponding to the effect of an inclined plane. The angle the the flank 123 includes, in the plane of the drawing in FIG. 5, with a radial line from the pivot axis 114 of the sole holder 110 determines the magnitude of the force acting on the retaining lever 119. That pivot force which acts on the retaining lever 119, being reduced in the relationship of the respective spacings of the two retaining rollers 120*a* and 120*b* from the pivot axis 118, acts on the convex cam portion 141 of the contact surface or cam 140. The spacing of the point of contact between the upper retaining roller 120*b* and the convex cam portion 141, from the pivot axis 124 of the opening lever 112, in turn determines the moment which acts on the opening lever 112 and which is transmitted by the retaining lever 119, and therewith the degree of prestressing of the compression spring 111.

In the position of the heel holder arrangement 108 shown in FIG. 5, the lower retaining roller 120*a* is just at the transition from the flank 123 of the retaining recess or notch 122 to the downwardly extending leg portion of the cam 121 while the upper retaining roller 120*b* is just at the point of entry into the concavely recessed cam portion 142 of the contact surface or cam 140. Until that relative position is reached, the lower retaining roller 120*a* has moved along the flank 123 by an extent which was permitted by the pivotal movement of the retaining lever 119. The pivotal movement of the retaining lever 119 was in turn determined by the rolling movement of the upper retaining roller 120*b* against the convex cam portion 141 towards the concave cam portion 142, the spacing of the upper retaining roller 120*b* from the pivot axis 124 of the opening lever 112 being reduced with increasing corresponding pivotal movement of the opening lever 112 downwardly. Until attainment of the relative position shown in FIG. 5 of the retaining rollers 120*a*, 120*b* relative to the associated cams 121 and 140 respectively therefore there is a force/travel characteristic which is determined by both cams 121 and 140, during the opening movement of the sole holder 110, and that characteristic, in spite of a relatively small angle of pivotal movement of the retaining lever 119, provides the desired linear configuration of the force/travel curve up to the moment of ski binding release, substantially independently of frictional influences. With only slightly further pivotal movement relative to the position shown in FIG. 5, the upper retaining roller 120*b* passes into the concave cam portion 142 and thus permits further pivotal movement of the retaining lever 119 in the clockwise direction such that the lower retaining roller 120*a* can finally pass the release edge between the flank 123 and the downwardly adjacent portion of the cam 121. Accordingly, the sole holder 110 can pivot upwardly about its axis 114 into the release position, as a result of the opening force applied to the sole holder 110 by the ski boot. In order to permit the opening lever 112 to perform the pivotal movement which occurs in that situation, the opening lever 112, in each of its side walls, has an arcuate slot 131 through which the pivot axis 114 passes.

A brace or strut member 135 in the form for example of a flat stamped member is pivotally mounted on the pivot axis 114. The brace member 135 bears with its front end of a rounded configuration in a recess indicated at 136 in FIG. 5 at the rear side of the sole holder 110 while at its rear end portion the member 135 has a mounting bore 137 through which passes the pivot axis 114 for pivotally mounting the member 135. The rear end face of the brace member 135, which is towards the right in FIGS. 4 and 5, in its portion which in FIG. 4 is to the left of the center line of the guide shank 127, is of an arcuate contour, the center of curvature of which is at the center of the pivot axis 114. To the right of the center line of the guide shank 127, the rear end face of the brace member 135 goes into a run-on or contact surface 138 which projects in a cam-like configuration, the spacing thereof from the center of the pivot axis 114 increasing in a clockwise direction in the manner clearly visible in both FIGS. 4 and 5. The dimensions of the brace member 135 and in particular the rear end face thereof, and the pressing portion 127, in particular the mounting opening thereof, are so matched to each other that, when the components are in the relative position shown in FIG. 4, the compression spring 111 bears fully against the pivot axis 114 and the rear end face of the brace member 135 bears substantially without force against the pressing portion 126, at most, with its arcuate contour.

When the heel holder arrangement 108 is to be voluntarily or deliberately opened, starting from the locking position of the sole holder 110 shown in FIG. 4, the opening lever 112 is pivoted in the clockwise direction about its axis 124 by hand or by means of a ski pole, with the compression spring 111 also being pivoted by virtue of being arranged in the opening lever 112. As the pivot axis 114 against which the compression spring 111 bears is admittedly disposed in the vicinity of the pivot axis 124 of the opening lever 112 but is at a small spacing therefrom and behind same, the result of the pivotal movement of the compression spring 111 is prestressing of the compression spring 111, which also increases with an increasing angle of pivotal movement. In addition, when that happens, the pressing portion 126 performs a part-circular movement about the pivot axis 114, in the course of which it passes on to the contact surface 138 of the brace member 135. As a result, the pressing portion 126 is lifted away from the pivot axis 114, with the compression spring 111 being further stressed at the same time. On the other hand, with increasing pivoting movement of the opening lever 112 and with the pressing portion 126 passing on to the contact surface 138 of the brace member 135 as a result, the compression spring 111 applies an increasing force to the brace member 135, which seeks to pivot the brace member 135 in the clockwise direction about the pivot axis 114. As the brace member 135 bears against the sole holder 110, a corresponding torque is applied to the latter, acting in the direction of its release position.

Since, as a result of the pivotal movement of the opening lever 112, the contact surface or cam 140 moves away from the upper retaining roller 120*b*, the lower retaining roller 120*a* is urged out of the retaining notch or recess 122 under the effect of the rearwardly directed force applied by the flank 123 of the retaining notch or recess 122, until the lower retaining roller 120*a* moves into the position shown in FIG. 5. That is in turn made possible by the fact that, at that moment, the upper retaining roller 120*b* drops into the concave cam portion 142 and as a result the retaining lever 119 can be pivoted in the clockwise direction by a relatively low force. When the lower retaining roller 120*a* has completely left the retaining notch or recess 122, the sole holder 110 is no longer blocked and can abruptly be pivoted upwardly into its release position by virtue of the force applied by the compression spring 111, by way of the brace member 135.

When the opening lever 112 is released again, the compression spring 111 pivots it back into its starting position again. As however the sole holder 110 now occupies its release position, the upper retaining roller 120*b* and therewith the retaining lever 119 are pivoted in the counter-clockwise direction by the projection 130, that is to say by the convex cam portion 141, with the lower retaining roller 120*a* being pressed against the part of the cam 121 which is beneath the retaining notch or recess 122. When the sole holder 110 is loaded downwardly, for example by the skier pressing with the ski boot on the kicker spur portion 116, the lower retaining roller 120*a* again moves upwardly on the cam 121 until it again passes into the retaining notch or projection 122 and the sole holder 110 thereby again occupies its locking position as shown in FIG. 4. In that respect, the configuration of the part of the cam 121 which is outside the retaining notch or recess 122, in an upward direction, again determines the force which acts on the lower retaining roller 120*a* and which loads the retaining lever 119 in the clockwise direction, being converted into stressing of the compression spring 111 by the upper retaining roller 120*b* and the contact surface 140 which bears thereagainst. As however that stressing of the compression spring 111 remains within limits as a result of the upper retaining roller 120*b* increasingly dropping into the convex cam portion 142 of the cam or contact surface 140 in the course of the pivotal movement of the opening lever 112, the closing force to be applied by the skier to the sole holder 110 also remains low, as is a desirable consideration. In that respect, as a result of the configuration of the concave cam portion 142, it is possible for the angle of inclination of the portion of the cam 121 which lies outside the retaining notch or recess 122, relative to a radial line through the pivot axis 114 of the sole holder 110, to be so great that the angle of friction at which there would be a fear of a self-locking action is exceeded in any case.

It will be appreciated that the above-described structures have only been set forth by way of example and illustration of the principles of the present invention and that modifications and variations may be made therein without thereby departing from the spirit and scope of the invention. Thus for example the retaining member formed by the retaining rollers 120a and 120b in the embodiment of FIGS. 4 through 6 does not necessarily have to be disposed on the retaining lever. It is also possible for the position of the cams 121 and 140 to be interchanged with those of the retaining rollers, so that for example one of the two cams is formed at one side of the retaining lever while the retaining roller associated with that cam is arranged on the sole holder 110 or on the projection 130 on the opening lever 112.

What is claimed is:

1. A heel holder arrangement of a safety ski binding, comprising: a housing; a sole holder on the housing about a first axis which is at least substantially parallel to the surface of the ski on which in use the heel holder arrangement is disposed between a heel locking position and a heel release position; a retaining means pivotable between first and second positions about a second axis at least substantially parallel to the surface of the ski, the retaining means being adapted in its first position to hold the sole holder in its locking position; an opening lever pivotable about a third axis at least substantially parallel to the surface of the ski for voluntarily moving the sole holder into the release position, the pivotal opening movement of the opening lever allowing the retaining means to move towards its second position for release of the sole holder; a compression spring operatively associated with the opening lever and pivotable together with the opening lever and adapted to be stressed by the pivotal opening movement thereof; a first support means on the opening lever for a first end of the compression spring; a second support means for the second end of the compression spring, the second support means being fixed with respect to the housing, the second end of the compression spring being adapted to describe a path of movement in the pivotal movement of the opening lever; a pressing portion on said compression spring at least adjacent said second end thereof; a brace member mounted pivotably at an axis which is parallel to the surface of the ski, the brace member having a contact surface which extends transversely to the pivot axis and which is arranged in the path of movement described by said second end of the compression spring in such a way that, in the course of the pivotal movement of the opening lever, the compression spring is stressed and said pressing portion of said compression spring passes on to said contact surface of said brace member thereby to urge the brace member against the sole holder in a direction towards the release position thereof whereby the sole holder is movable into its release position after release of said retaining means.

2. An arrangement as set forth in claim 1 wherein said retaining means comprises a retaining roller and a detent means co-operable with the retaining roller to hold the sole holder in its locking position.

3. An arrangement as set forth in claim 1 wherein said retaining means comprises a retaining lever carrying at least one retaining roller, and wherein said sole holder provides a cam means including a retaining recess into which said at least one retaining roller is adapted to engage in the locking position of the sole holder, thereby to retain the sole holder in its locking position.

4. An arrangement as set forth in claim 1 wherein said first axis forms said second support means for the compression spring.

5. An arrangement as set forth in claim 1 wherein said first axis is at the same time the pivot axis for the brace member.

6. An arrangement as set forth in claim 1 wherein said second support means for the compression spring is disposed adjacent the third axis and behind said third axis.

7. An arrangement as set forth in claim 1 wherein said first support means for the compression spring on the opening lever is disposed at the free end of the opening lever.

8. An arrangement as set forth in claim 1 wherein the sole holder has a recess into which the brace member engages.

9. An arrangement as set forth in claim 8 wherein said recess is arranged between the surface of the ski and said first axis about which the sole holder is pivotable.

10. An arrangement as set forth in claim 1 wherein the compression spring includes a guide shank carrying said pressing portion at least adjacent the said end of said compression spring and wherein said pressing portion is mounted on said first axis pivotably and displaceably in the direction of the guide shank.

11. An arrangement as set forth in claim 10 wherein the pressing portion embraces said first axis in a fork configuration and has an opening into which the contact surface of the brace member projects.

12. An arrangement as set forth in claim 2 wherein said detent means has a flank which co-operates with the detent roller and so shaped that, when the sole holder is loaded by the brace member, the retaining roller and the detent means are acted upon by a force urging them apart.

13. An arrangement as set forth in claim 2 including a retaining lever on which the retaining roller is arranged and wherein the retaining recess is on the sole holder.

14. An arrangement as set forth in claim 13 wherein the opening lever has a contact surface adapted to engage the retaining lever in the sole holder locking position under the spring loading.

15. An arrangement as set forth in claim 14 wherein said contact surface of said opening lever bears against said retaining roller.

16. In a safety ski binding a heel holder arrangement comprising: a sole holder which is pivotable about a first axis at least substantially parallel to the surface of the ski on which in use the ski binding is disposed between a position of locking the heel of a boot and a release position; a retaining lever having a lower end and an upward end and pivotable at its lower end about a second axis disposed behind the sole holder; at least one retaining roller carried on said retaining lever at least adjacent its said upward end; a cam means on the sole holder co-operable with the retaining roller and including a retaining recess adapted to receive the retaining roller when the sole holder is in its locking position; an opening lever pivotable about a third axis for opening the heel holder arrangement; a cam means on the opening lever, the cam means on the sole holder and the cam means on the opening lever jointly determining the force/travel characteristic of the sole holder both upon safety release of the arrangement and also upon voluntary opening by pivotal actuation of the opening lever; a compression spring operatively associated with the opening lever and adapted to be stressed by pivotal opening movement thereof, the spring being pivotable with the opening lever in its pivotal opening movement; and a brace member having first and second ends and pivoted at its first end at least adjacent said first axis and engaging at its second end said sole holder, the brace member at its first end also having a contact surface adapted to be engaged by said compression spring as it is pivoted and thereby stressed upon pivotal opening movement of the opening lever, whereby the brace member is pivoted about its mounting axis under the loading of the compression spring thereby to urge the sole holder pivotally towards its release position after the pivotal opening movement of said opening lever moves the cam means of said opening lever away from said retaining roller to allow the retaining roller to disengage from said retaining recess.

17. A heel holder arrangement of a safety ski binding comprising: a housing; a sole holder mounted to the housing pivotably about a first axis which is at least substantially parallel to the surface of the ski on which in use the arrangement is disposed between a locking position and a release position, the ski holder including a cam means having a detent means; a retaining lever which is pivotable about a second axis which is at least substantially parallel to the first axis; a retaining member which is carried by the retaining lever and which is adapted to engage said cam means of the sole holder; a compression spring adapted to press the retaining member into a detent means of the cam means to retain the sole holder in the locking position, the retaining member being pressed out of the detent means against the force of the compression spring when a predetermined opening force acting on the sole holder is exceeded, so that the sole holder can pivot into the release position; and an opening lever mounted to the housing pivotably about a third axis which is at least substantially parallel to the first and second axes, the opening lever having a contact surface for contact with the retaining member of the retaining lever, the compression spring being operable to load the retaining member by way of the opening lever and the contact surface thereof, and wherein the retaining member is formed by first and second retaining rollers which are disposed on the retaining lever and of which one is co-operable with the cam means of the sole holder and the other is co-operable with the contact surface of the opening lever.

18. An arrangement as set forth in claim 17 wherein the contact surface of the opening lever is in the form of a cam means having a concavely inwardly extending cam portion into which the retaining member can pass upon the pivotal movement of the sole holder into the release position thereof.

19. An arrangement as set forth in claim 18 wherein the position of the inwardly extending cam portion of the contact surface and the position of a flank of the detent means of the cam means of the sole holder are so selected that, when the sole holder is in a pivotal position corresponding to the predetermined opening force being exceeded, the opening lever is also urged into a pivotal position in which the retaining member can engage into the inwardly extending cam portion.

20. An arrangement as set forth in claim 17 wherein said contact surface of the opening lever is formed by a nose-shaped projection on the opening lever.

21. An arrangement as set forth in claim 17 wherein the retaining rollers are arranged in at least substantially mutually parallel relationship.

22. An arrangement as set forth in claim 21 wherein the pivot axis of the retaining lever is disposed beneath the pivot axes of the sole holder and the opening lever, the retaining lever extends upwardly between the cam means and the pivot axis of the opening lever, and the retaining rollers are arranged one beneath the other at an upper end portion of the retaining lever.

23. An arrangement as set forth in claim 17 wherein the retaining rollers are arranged rotatably separately from each other on a common axis on the retaining lever.

24. An arrangement as set forth in claim 17 wherein the compression spring is disposed between a first support means on the opening lever and the first axis about which the sole holder is pivotable, and is pivotable together with the opening lever.

25. An arrangement as set forth in claim 17 wherein the pivot axis of the sole holder is disposed adjacent the third axis about which the opening lever is pivotable and behind said third axis.

26. An arrangement as set forth in claim 21 wherein the first support means is disposed at the free end of the opening lever.

* * * * *